United States Patent [19]

Koenig et al.

[11] Patent Number: 4,606,727

[45] Date of Patent: Aug. 19, 1986

[54] ANCHORING ARRANGEMENT FOR A TANKER, INCLUDING A FLUID TRANSFER SYSTEM

[75] Inventors: Dieter Koenig, Seevetal; Hansjörg Klante, Wedel; Manfred Niemann, Hamburg; Wilhelm Jenny, Hamburg; Jürgen Engelskirchen, Hamburg, all of Fed. Rep. of Germany

[73] Assignee: Blohm & Voss AG, Hamburg, Fed. Rep. of Germany

[21] Appl. No.: 679,563

[22] Filed: Dec. 7, 1984

[30] Foreign Application Priority Data

Dec. 7, 1983 [DE] Fed. Rep. of Germany ..... 3344116

[51] Int. Cl.[4] ..... B63B 21/52

[52] U.S. Cl. ..... 441/5; 441/4; 114/230

[58] Field of Search ..... 441/3, 4, 5, 123; 114/256, 264, 144 B, 230, 293, 267; 405/202; 166/355, 356, 350

[56] References Cited

U.S. PATENT DOCUMENTS

| | | | |
|---|---|---|---|
| 3,407,768 | 10/1968 | Graham et al. | 114/256 |
| 3,440,671 | 4/1969 | Smulders | 9/8 |
| 3,602,302 | 8/1971 | Kluth | 114/264 |
| 3,605,668 | 9/1971 | Morgan | 441/3 |
| 3,620,181 | 11/1971 | Naczkowski | 441/3 |
| 4,321,720 | 3/1982 | Havre | 114/257 |

FOREIGN PATENT DOCUMENTS

| | | |
|---|---|---|
| 1506729 | 8/1973 | Fed. Rep. of Germany . |
| 1447413 | 8/1976 | United Kingdom . |

*Primary Examiner*—Trygve M. Blix
*Assistant Examiner*—C. T. Bartz
*Attorney, Agent, or Firm*—Nils H. Ljungman

[57] ABSTRACT

An anchoring system for a converted tanker, including a fluid transfer line extending from the sea bed to the tanker, uses a vertical hollow shaft which is integrated into the stern portion of the tanker. A buoy, which is generally annular, is located under the vertical hollow shaft and anchored. Attached to the buoy, vertically above the buoy, is a hollow columnar superstructure which is disposed coaxially with the hollow shaft and is unaffected by weather. The superstructure is supported and located in vertical and horizontal directions coaxially inside of the hollow shaft by top and bottom pivot bearings which may be lubricated by sea water. The anchoring per se of the tanker takes place through the hollow superstructure member and the anchored buoy. The shaft and superstructure can be evacuated dry without any sea water, for maintenance personnel to inspect or replace the bearings and for completing repairs to the transfer line which is disposed within the hollow superstructure.

19 Claims, 4 Drawing Figures

ANCHORING ARRANGEMENT FOR A TANKER, INCLUDING A FLUID TRANSFER SYSTEM

BACKGROUND OF THE INVENTION

1. Field of the Invention

This invention generally relates to anchoring arrangements for floating structures and more particularly to anchoring arrangements for floating structures such as converted tankers.

2. Description of the Prior Art

The traditional anchoring arrangements comprising any of the known types of anchors cater to the anchoring requirements of seagoing vessels and other floating structures, for example, tankers, which are either at a dock or a harbor. Occasionally, certain conventional anchoring arrangements are used to anchor vessels in the open sea. However, it is known that conventional anchoring will not be very effective if the floating structure or vessel is in high seas, especially when it is required to connect a transfer hose or an underwater transfer tube carrying a fluid, for example oil or gas, to the floating vessel. Even with anchoring, a certain degree of shifting of the floating structure, or even a certain degree of rotation of the floating structure, might occur in high seas. At least one consequence of such shifting or rotation is that the transfer hose, for example, tends to get damaged or even disconnected, causing serious consequences. The problem is especially serious in the case of ocean vessels such as converted tankers in high seas wherein there is need for having at least a transfer tube constantly connected to the tanker through the ocean water, invariably to the sea bed or the shore or another vessel. Certain structural arrangements have been used heretofore to cater to the needs of stably and permanently anchoring converted tankers, simultaneously making provision for a transfer pipe or tube connected between the tanker and the sea bed. However, prior art arrangements have always required a significant mass of steel to fabricate the underwater anchoring structure, consequently rendering the equipment expensive from the poin the view of installation and maintenance. Furthermore, it has been found that it is desirable to provide an underwater means which permits relative rotary movement between the tanker superstructure and the anchoring arrangement to make a provision for oscillatory and rotary swaying movements of the tanker superstructure in high seas. Preferably, the underwater means should have a pivot bearing mechanism to easily permit such movement. Also, it is desirable that there should be easy access for maintenance personnel to reach at least part of the bearing mechanism to attend to maintenance and replacement work, preferably in a dry atmosphere. Such facilities are not available in any known prior art anchoring arrangement.

There is, therefore, a great need for an anchoring arrangement devoid of the disadvantages and limitations of prior art and including the more desirable features which are discussed above.

There is also a great need for an anchoring and transfer system which is low in cost and can be installed in a converted tanker using only minimum labor, wherein only a small working area is required at the anchorage. There is also a need for an anchoring arrangement including a transfer system wherein there is excellent accessibility to the anchoring apparatus, and wherein the fluid transfer system is weatherproof, and protected against collision.

OBJECTS OF THE INVENTION

An object of this invention is to provide a permanent anchoring and transfer system for a converted tanker, with a simple transfer system for transferring liquid and gaseous media, the anchoring system being preferably integrated into the stern of the tanker. The invention also provides an anchoring system for a converted tanker, wherein the anchoring arrangement uses a buoy which is integrated into the stern of the tanker, and which anchoring arrangement is capable of being serviced without the need for any divers. The arrangement is advantageously built into the body of the tanker in such a manner that there is weatherproof access to structure which might need periodic maintenance. At the same time, by the use of the invention, only a relatively small degree of vertical motion of the tanker caused by the sea is transmitted to the anchor line and anchor cables with the result that the wear on the anchor line and anchor cables is very minimal.

It is also an object of the invention to provide an anchoring and transfer system wherein the installation of the entire anchoring system can be completed during a docking time interval which may be sufficient for the conversion of the tanker into a storage or production tanker. By such arrangement, the transfer hose can be successfully operated with little or no flexible portion, but with only a fluid-proof swivel joint and a telescopic sealing guide having replaceable sealing elements.

SUMMARY OF THE INVENTION

The invention in its broad form comprises an anchoring system for a tanker, including a fluid transfer tube line entering the tanker, the anchoring system using a buoy and comprising: a vertical hollow shaft which is integrated into the tanker, said buoy being disposed in use under said vertical hollow shaft, said buoy being anchored by a plurality of anchor cables, the buoy including a vertically extending hollow superstructure which surrounds said transfer tube line, said hollow superstructure being pivoted for relative rotation inside of and substantially concentric with said vertical hollow shaft, said anchoring system including pivot bearing means supporting said hollow superstructure in radial and axial directions with respect to said hollow shaft, whereby vertical movement of the tanker stern via the hollow shaft are prevented relative to the buoy.

As described hereinafter, a preferred embodiment of the invention features a completely weatherproof and permanent anchoring and transfer system for a tanker using a buoy and associated structure which is integrated into the stern portion of the tanker. Advantageously, the anchoring and transfer system described uses a vertical hollow shaft built into the stern portion of the tanker such that the hollow shaft supports vertically and horizontally the hollow superstructure by means of upper and lower pivot bearings of the friction bearing type which are lubricated by sea water. The hollow portion of the shaft and the hollow superstructure can be drained and dried out for maintenance personnel to obtain access to the transfer hose extension, and its associated telescopic guide.

BRIEF DESCRIPTION OF THE DRAWINGS

The invention and its various features may be more fully understood from the following description of an exemplary embodiment, to be read and understood in conjunction with the accompanying drawings wherein.

DESCRIPTION OF THE PREFERRED EMBODIMENTS

Figure 1:
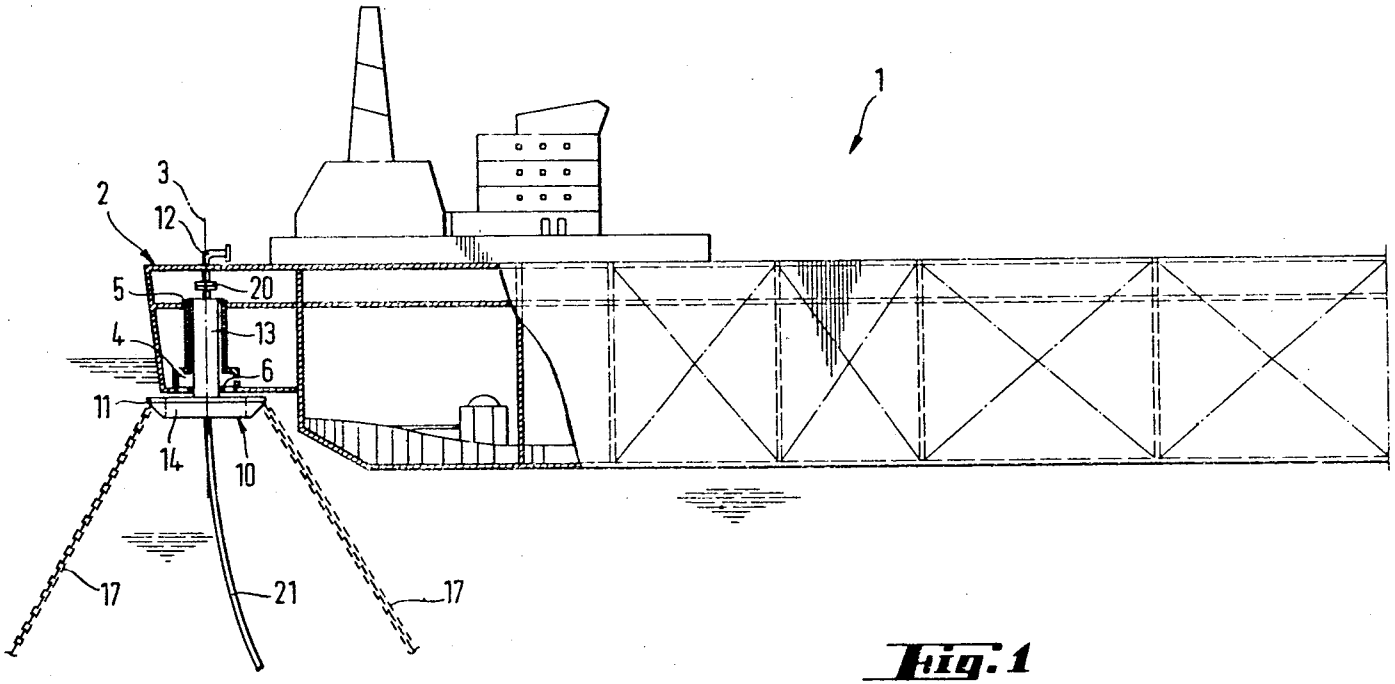
FIG. 1 shows a schematic view in longitudinal section of the stern of the tanker and the anchoring and transfer system according to the invention.

Illustrated in the figures in a diagrammatic fashion is a tanker 1 having a stern portion 2, which is anchored using a buoy 10 which has an attached hollow columnar superstructure 13; the structure 13 passes through a shaft 4 which has an extension by way of an integrated expansion along the vertical axis 3.

In the typical embodiment of the invention as illustrated in the drawings, the columnar superstructure 13 is so mounted that it can freely rotate coaxially within the shaft 4. To the underside of the structure 13, a spacious platform 14 formed by the buoy 10 is attached, which is anchored by the anchor cables or chains 17 by the use of anchor cable attachments 11, as shown in FIGS. 1, 2, 3 and 4. The axis of the columnar structure preferably coincides spatially with the structural axis of the rudder shaft (not shown) in the tanker stern 2. An integrated expansion in the shaft 4 of the stern 2 accommodates a bearing support and holds the columnar structure 13 of the buoy 10 as well as the bottom bearing 6. Both the superstructure 13 and the shaft 4 expanded downward are open on bottom and are generally flushed by sea water.

The upper and lower bearings 5 and 6 respectively, support and locate the columnar structure of the buoy 10 in the radial direction. The bearings 5 and 6 preferably are slide bearings using, for example, synthetic material and stainless steel. The upper bearing 5 is equipped with an airtight seal such as Pneumostop, a registered trademark. Both the shaft 4 and its integrated expansion can be filled with compressed air and the sea water contained therein expelled from the shaft 4. Thus the bottom bearing 6 can be inspected and serviced dry. Expediently, for this purpose, the maintenance personnel enter an air lock at 7, which is located in the upper portion of the columnar structure 13 and reach the expanded integrated space by means of a ladder which leads down and through an opening in the columnar structure 13. At this time, a flange coupling 19, which connectes the transfer hose 21 with the rigid transfer line 12 suspended in the middle of the columnar structure 13, can be inspected and serviced. Most importantly, the connection of the transfer line 12 can be done without the help of divers. The so-called swivel 20 of the transfer tube is above the columnar structure 13 of the buoy 10, for example, in the former rudder machine room of the tanker 1, and is, therefore, accessible at all times and is easy to service.

Figure 3:
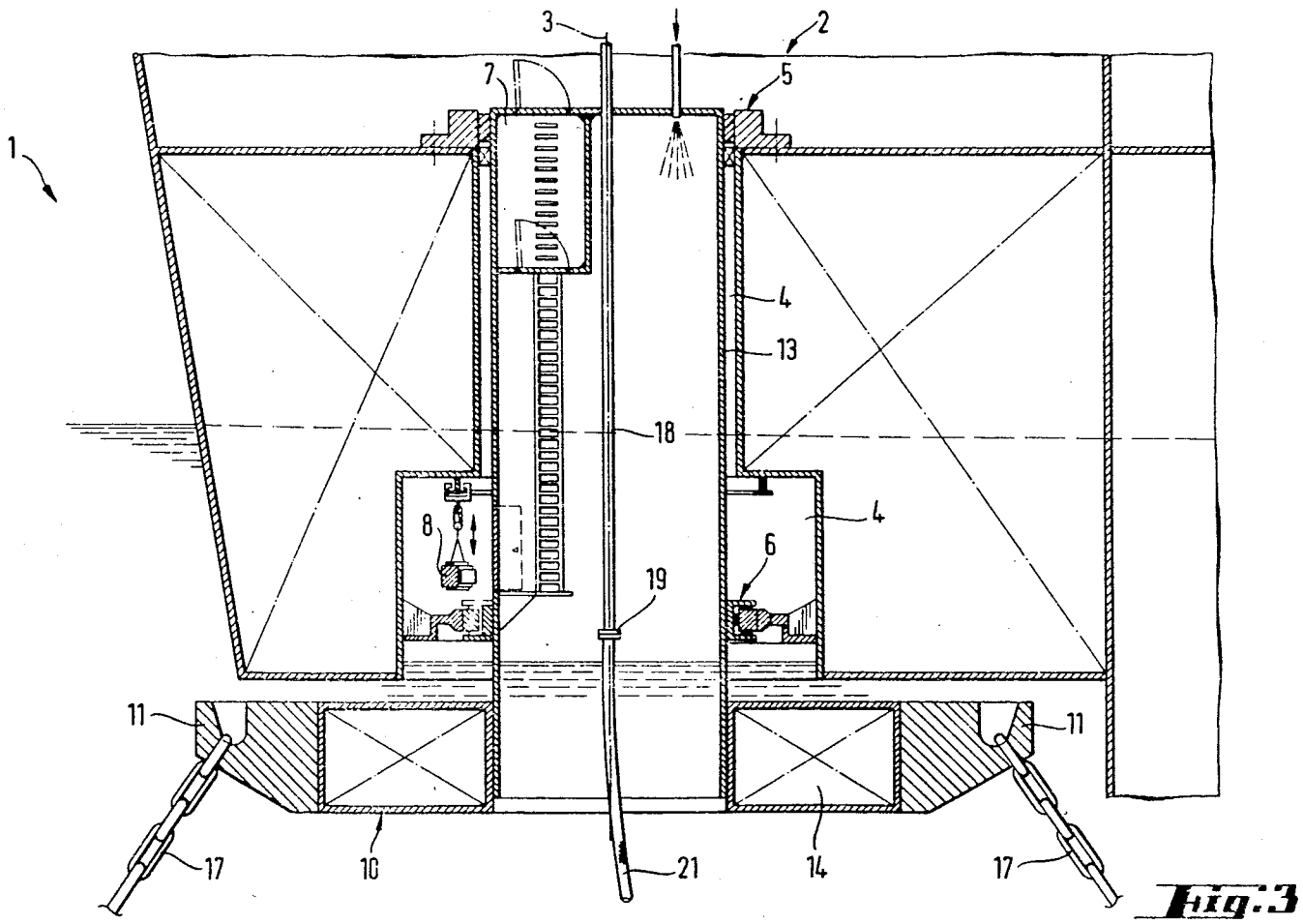
Figure 4:
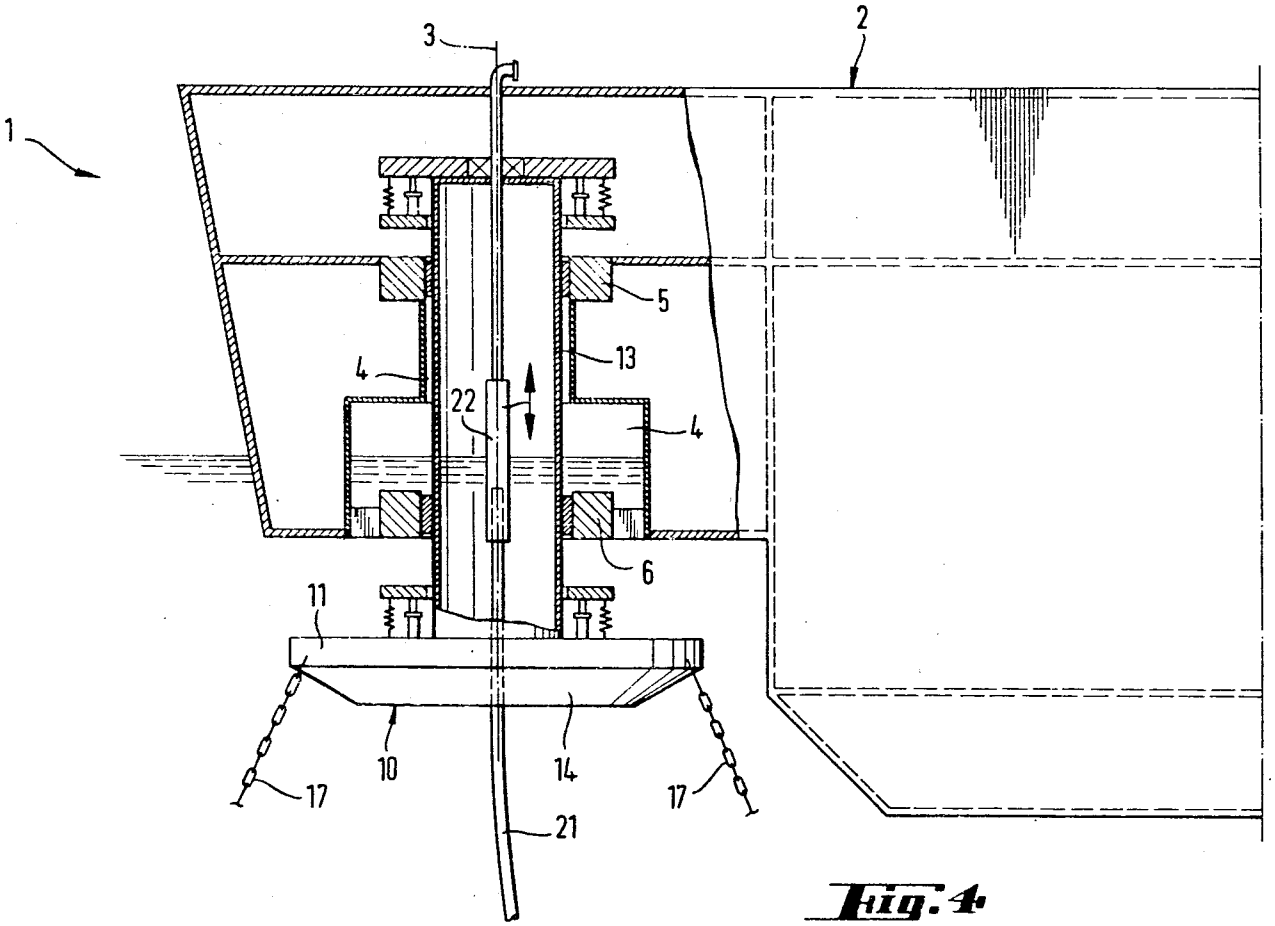
FIG. 4 shows the same view as FIGS. 2 and 3, but with a buoy which has limited axial movement.

As shown in FIG. 3, the bearings 5 and 6 between the columnar structure 13 of the buoy 10 and the shaft 4 are friction bearings and are expediently divided into segments 8, so that individual segments 8 can be hoisted by on-board means (for example, block and tackle), for inspection and replacement if necessary. For this purpose the water surrounding the bearings 5 and 6 is expelled from the integrated space with compressed air and the rotation of the rotary bearing blocked by suitable draw spindles (not shown) on the circumference of the bearings 5 and 6.

Figure 2:
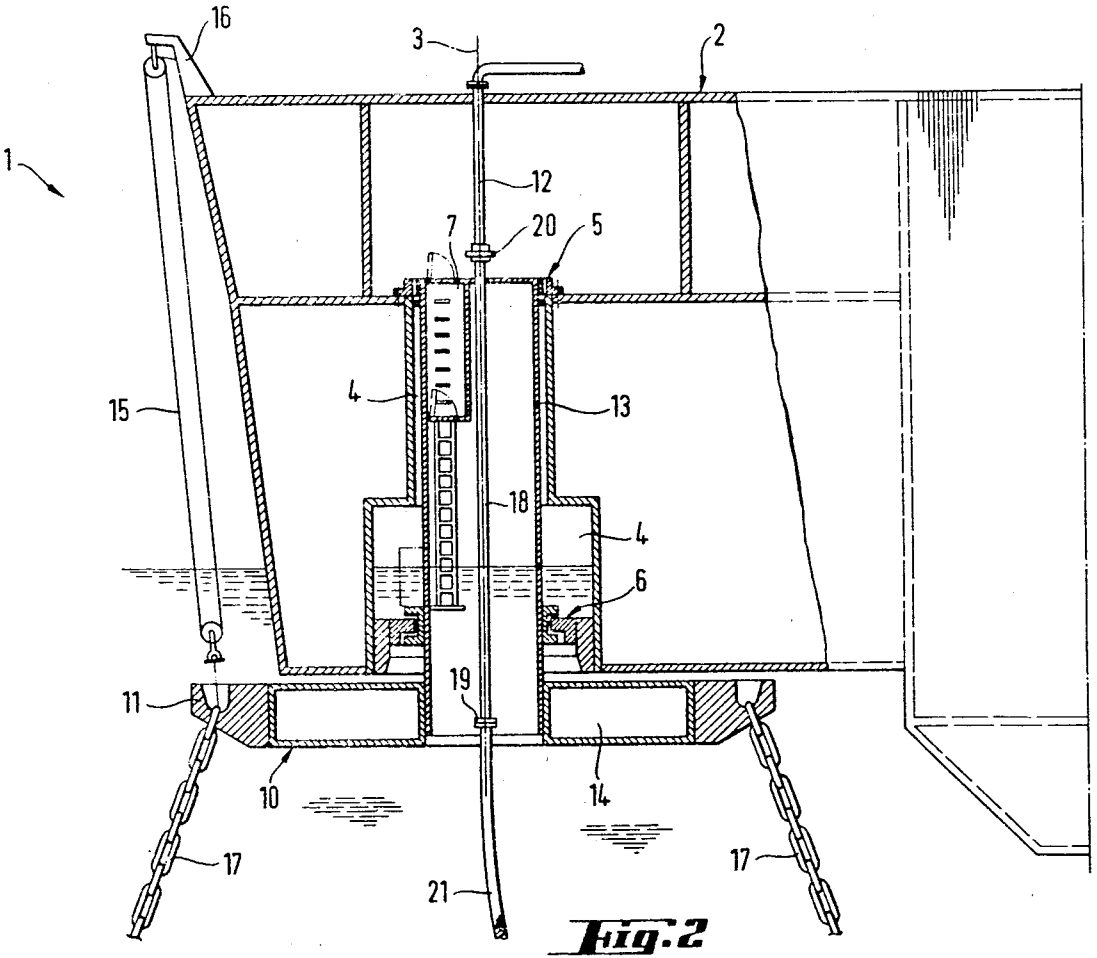
FIGS. 2 and 3 show the same view as FIG. 1, on a larger scale, with a buoy which cannot move in the axial direction.

As shown in FIG. 2, the anchor chains 17 can optionally be braced with on-board means (for example, by means of a tackle 15 and a davit 16 on the stern end 2 of the tanker 1). By adjusting the trim of the tanker 1 when ballasted, the anchor chains 17 can also be suspended so that they hang above the surface of the water, so that no diving is necessary to reach them.

The hollow shaft 4 may have means to allow limited relative axial displacement between the hollow shaft 4 and the columnar superstructure 13.

For the installation of the anchorage in a dock of a shipyard, the rudder, the rudder shaft, rudder machine, propeller and a portion of the shell of the tanker 1 are removed. Then, the reinforced shaft structure 4 is placed under the stern 2 and welded to the tanker structure 1.

Next, the buoy structure 10, which is expediently completely assembly on land, with its columnar structure 13 is set upright on the bottom of the dock. The dock is flooded and the tanker 1 floated over the buoy 10. The hoist lines attached to the buoy platform 14 are pulled in, guided through openings in the tanker 1 and the buoy 10, with the possible simultaneous discharge of ballast from the buoyancy chamber of the buoy into the shaft 4 of the tanker 1 and attached. The load-bearing segments 8 of the lower bearing 6 are previously installed in the annulus of the shaft 4 whereby, the segments of the axial pivot bearing 6 are readily installed in the integrated space 4. After the buoy 10 is drawn in against the stop of the lower axial pivot bearing 6, the upper bearing 5 is installed. Then, the parts of other mechanical equipment are erected in the superstructure 13 of the buoy 10. The complete unit—tanker 1 with buoy 10—can now be towed to the anchorage.

It is seen from the foregoing description that the anchoring and transferring system of the invention provides unique features and advantages over known prior art arrangements.

As shown in FIG. 1, the anchoring apparatus is integrated into the stern 2 of the tanker 1 with the result that only very little time for installation at the final location is needed. In addition, the invention is more economical in terms of labor and cost as compared to known prior art arrangements. Additionally, there is no need for divers in the present anchoring apparatus to reach the bearings 5 and 6 for inspection and maintenance. Likewise, the upper transfer line 12 also can be inspected and maintained by ordinary maintenance personnel from the tanker 1 per se, especially since the shaft superstructure 13 is weatherproof and can be entered easily by maintenance personnel from the tanker 1. Simultaneously, it is made possible that only a relatively small amount of vertical motion caused by the motion of the sea is transmitted to the transfer lines 12 and 18 and the anchor cables 17.

As a modification of the inventive anchoring and transfer system, it is envisaged that the buoy 10 and the associated superstructure 13 be anchored in such a manner that vertical movement and oscillation of the buoy 10 is prevented relative to the sea bottom. While this arrangement would prevent or minimize wear of the anchor cables 17 and transfer line 21, it would however necessitate only simple replacement of seal elements of a telescopic guide 22, shown in FIG. 4, of the transfer line 21 inside the buoy 10, periodically. In any event, as a result of the buoy 10 being integrated into the stern 2 of the tanker 1, the problems of prior art buoys floating on long fork-shaped lever arms are completely eliminated by the present invention. As a direct consequence, the dimensions of the pivot bearings 5 and 6 are reduced in the present invention. Moreover, since the installation time at the final anchorage location can be kept short, the anchor cables 17 can be hauled in by means on-board the tanker 1 without any need for engaging a floating crane. It is also to be noted that the bottom pivot bearing 6 is constantly lubricated by sea water. The top bearing 5 may also be lubricated by sea water using a pump (not shown), if desired.

The invention is not be taken to be limted to all the details of the description given hereinabove, since variations and modifications of the invention are possible without departing from the scope of the invention which is defined by the appended claims.

What is claimed is:

1. An anchoring system for a tanker, including a fluid transfer tube line entering the tanker, said anchoring system using a buoy and comprising:

a vertical hollow shaft which is integrated into a stern portion of the tanker, said buoy being disposed in use completely under said stern portion and under said vertical hollow shaft;

said buoy being anchored by a plurality of anchor cables;

said buoy including a vertically extending hollow columnar superstructure which is disposed above said buoy and rigidly connected thereto to surround said transfer tube line;

said hollow columnar superstructure being pivoted for relative rotation inside of and substantially concentric with said vertical hollow shaft;

said anchoring system including pivot bearing means supporting said hollow columnar superstructure in radial and axial directions with respect to said vertical hollow shaft; and said pivot bearing means preventing any relative vertical movement of said stern portion with respect to said buoy, but permitting relative rotary motion between said hollow columnar superstructure and said stern portion.

2. The anchoring system as in claim 1 including top and bottom pivot bearings locating and centering said superstructure inside of said hollow shaft.

3. The anchoring system as in claim 2 wherein said hollow shaft is welded in a stern portion of the tanker in lieu of a rudder shaft of the tanker which rudder shaft is removed for installing the anchoring system.

4. The anchoring system as in claim 1 wherein said buoy is substantially annular in configuration and features an annular platform to which anchoring cables are fastened, said hollow superstructure being formed coaxially with the buoy.

5. The anchoring system as in claim 2 wherein said bottom bearing is so located that it is constantly exposed to sea water to be lubricated thereby in use, at least said bottom bearing being of sectionalized construction comprising stainless steel and synthetic material.

6. The anchoring system for a tanker including said fluid transfer line as in claim 1, including a swivel joint means disposed in the fluid transfer tube line and located substantially adjacent to an upper region of said columnar structure.

7. The anchoring system as in claim 6, including a pressure lock region disposed within said hollow columnar superstructure, the system including access from the tanker to an integrated space adjacent to said hollow shaft.

8. The anchoring system as in claim 5, including pump means to lubricate said top pivot means with sea water and including means to allow a limited axial movement of said superstructure within said hollow shaft.

9. The anchoring system as in claim 8, wherein at least some of said anchor cables comprise chains and are braced with on-board means comprising davit means mounted at a stern end of the tanker.

10. In an anchoring system for a tanker, of the type using an anchored buoy and wherein relative rotation between the buoy and the tanker is desirable, the system also being of the type wherein a fluid transfer line in the form of a pipe has to be maintained and led into the tanker, the improvement comprising:

a buoy which, in use, is disposed completely under a stern portion of the tanker, said buoy including a plurality of anchoring cables, said buoy also including an integral vertically rising cylindrical hollow superstructure;

a hollow shaft which is integrated into a stern portion of the tanker, in place of a rudder portion of the tanker which rudder portion is removed, said hollow shaft being of such internal diameter as to coaxially accommodate said cylindrical hollow superstructure radially inside of said hollow shaft;

upper and lower pivot bearing means disposed between said cylindrical hollow superstructure and said hollow shaft so as to coaxially support said cylindrical hollow superstructure in radial and axial directions within said hollow shaft;

said pivot bearing means preventing any vertical movement of said stern portion relative to said buoy, but permitting relative rotary motion between said cylindrical hollow superstructure and said stern portion; and said fluid transfer line including a swivel type tube joint and being disposed substantially vertically in said cylindrical hollow superstructure.

11. An anchoring and transfer system for a tanker having a stern portion and a buoy disposed under the stern portion;

said anchoring system including a transfer tube line for conveying liquid and gaseous media;

said buoy including a vertically extending columnar superstructure integral with said buoy;

said anchoring system including a vertical hollow shaft rigidly fixed inside the tanker, said hollow shaft being disposed inside said tanker stern portion and being aligned to be coaxial with said columnar superstructure of the buoy;

said buoy including anchor cable attachments;

said transfer tube line being disposed through said buoy;

said anchoring system including bearing means supporting said columnar superstructure coaxially inside said hollow shaft; and said bearing means preventing relative vertical displacement between said columnar superstructure and said tanker stern portion.

12. The anchoring and transfer system according to claim 11 wherein said columnar superstructure is welded on top of said buoy to a spacious platform representing an anchor cable attachment.

13. The anchoring and transfer system according to claim 12 wherein the columnar structure of the buoy includes an extended platform, said columnar structure being guided inside said shaft and is radially and axially supported inside the hollow shaft by means of bearings.

14. The anchoring and transfer system according to claim 13 wherein said bearings include an upper bearing and a lower bearing and provide radial and axial guidance.

15. The anchoring and transfer system according to claim 14 including means to damp the movement of the columnar structure.

16. The anchoring and transfer system according to claim 15 wherein the bearings are friction bearings, having friction surfaces which comprise one of synthetic material and stainless steel and are lubricated by the entry of sea water at least at the bottom main bearing.

17. The anchoring and transfer system according to claim 15 wherein the bearings are divided into segments to facilitate repair and replacement.

18. The anchoring and transfer system according to claim 17 wherein for inspection and repair work on the bearings or on the transfer lines and their connections, the generally-flooded columnar structure, the buoy and parts of the shaft can be blown out by means of compressed air and are accessible to maintenance personnel via an air lock by means of gratings and ladders.

19. The anchoring and transfer system according to claim 18 including tackles in said stern portion which are fastened on one hand to the stern of the tanker on booms or davits and, on the other hand, to the edge of said buoy for adjusting said buoy with its columnar superstructure.

* * * * *